US009701144B2

(12) United States Patent
Kobayashi

(10) Patent No.: US 9,701,144 B2
(45) Date of Patent: Jul. 11, 2017

(54) LIQUID DROPLET DISCHARGING APPARATUS

(71) Applicant: Seiko Epson Corporation, Tokyo (JP)

(72) Inventor: Shunsuke Kobayashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/138,563

(22) Filed: Apr. 26, 2016

(65) Prior Publication Data

US 2017/0008322 A1 Jan. 12, 2017

(30) Foreign Application Priority Data

Jul. 10, 2015 (JP) ..... 2015-138476

(51) Int. Cl.

| | |
|---|---|
| ***B41J 2/165*** | (2006.01) |
| ***B41J 29/46*** | (2006.01) |
| ***B41J 29/13*** | (2006.01) |
| ***B41J 2/01*** | (2006.01) |
| ***B41J 25/00*** | (2006.01) |

(52) U.S. Cl.

CPC ..... *B41J 29/46* (2013.01); *B41J 2/01* (2013.01); *B41J 25/001* (2013.01); *B41J 29/13* (2013.01)

(58) Field of Classification Search

None

See application file for complete search history.

(56) References Cited

U.S. PATENT DOCUMENTS

| | | | | |
|---|---|---|---|---|
| 6,561,606 | B1 * | 5/2003 | Yoshida | B41J 25/3086 347/8 |
| 6,565,173 | B1 | 5/2003 | Murcia et al. | |
| 2009/0300374 | A1 * | 12/2009 | Mori | G06F 1/3203 713/300 |
| 2015/0224783 | A1 * | 8/2015 | Koganehira | B41J 2/17509 347/9 |

FOREIGN PATENT DOCUMENTS

| | | |
|---|---|---|
| EP | 2 682 271 A2 | 1/2014 |
| JP | 2013-203009 A | 10/2013 |

* cited by examiner

*Primary Examiner* — Alejandro Valencia
(74) *Attorney, Agent, or Firm* — Workman Nydegger

(57) ABSTRACT

A printing apparatus includes: a carriage that retains a discharge section that discharges liquid droplets (ink) onto a medium; a frame; a guide shaft; a guide rail that support the carriage in a manner that permits it reciprocating movement; a housing that supports the frame; a detection section that detects a relative positional relationship between the frame and the housing; and a control section. On the basis of the detection results of the detection section, the control section executes a warning process, which displays a warning on a display section, if the positional relationship changes, and does not execute the warning process if the positional relationship does not change.

12 Claims, 8 Drawing Sheets

LIQUID DROPLET DISCHARGING APPARATUS

BACKGROUND

1. Technical Field

The present invention relates to a liquid droplet discharging apparatus such as an ink jet printer.

2. Related Art

In the related art, printing apparatuses that are provided with a discharge section that discharges an ink (liquid droplets), a carriage that retains the discharge section, a guide rail (a support section) that supports the carriage in a manner in which the carriage is capable of reciprocating, and a housing that supports the guide rail, and performs printing by discharging the ink toward a medium from a discharge section while moving a carriage in a width direction, are known as examples of a liquid droplet discharging apparatus.

Among such printing apparatuses, there are printing apparatuses that can change the posture of the discharge section with respect to the carriage in order to resolve posture fluctuation of the discharge section that accompanies posture fluctuation of the carriage due to curvature of the guide rail when the carriage is moved in the width direction (for example, JP-A-2013-203009).

As a result of this, in such printing apparatuses, a circumstance in which shift occurs in the landing positions of ink that is discharged toward a medium from the discharge section, accompanying posture fluctuations during movement of the carriage, is suppressed, and therefore, reductions in printing precision are suppressed.

Incidentally, the posture fluctuations that such printing apparatuses resolve is inclination of the carriage with the guide rail set as a rotational axis thereof. That is, such printing apparatuses resolve inclination of the discharge section with the guide rail as a rotational axis thereof by relatively rotating the discharge section with respect to the carriage with the guide rail set as a rotational axis thereof on the basis of inclination of the carriage with the guide rail set as a rotational axis thereof.

Meanwhile, for example, in a case in which the printing apparatus is subjected to an impact, or the like, and the housing is no longer able to support the guide rail normally, there are cases in which posture fluctuations in which the guide rail is not set as the rotational axis thereof occur in the carriage. In this case, it is no longer possible resolve posture fluctuations of the discharge section that accompany posture fluctuations in the carriage even if the discharge section is relatively rotated with respect to the carriage with the guide rail set as the rotational axis thereof. As a result of this, there is a concern that it will no longer be possible to suppress a circumstance in which shift occurs in the landing positions of ink that is discharged toward a medium from the discharge section.

SUMMARY

An advantage of some aspects of the invention is to provide a liquid droplet discharging apparatus that can suppress a circumstance in which liquid droplets are discharged from the discharge section in a case in which the support section, which supports the carriage that retains the discharge section, in a manner in which the carriage is capable of reciprocating, is no longer supported normally by the housing.

Hereinafter, means of the invention and operation effects thereof will be described.

According to an aspect of the invention, there is provided a liquid droplet discharging apparatus including a carriage that retains a discharge section (i.e. discharger), which discharges liquid droplets onto a medium, a support section (i.e. support frame) that supports the carriage in a manner in which the carriage is capable of reciprocating movement, a housing that supports the support section, a detection section (i.e. position detector) that is capable of detecting a relative positional relationship between the support section and the housing, and a control section (i.e. controller) that, on the basis of the detection results of the detection section, executes a warning process, which displays a warning on a display section (i.e. display), in a case in which the positional relationship changes, and does not execute the warning process in a case in which the positional relationship does not change.

In this case, for example, in a case in which the relative positional relationship between the support section and the housing changes as a result of the liquid droplet discharging apparatus being subjected to an impact, the change in the positional relationship is detected by the detection section. Further, when it is determined that the positional relationship has changed, the control section displays a warning on the display section. In this manner, as a result of warning a user of the liquid droplet discharging apparatus of the fact that a change in the positional relationship has occurred, it is possible to suppress a circumstance in which liquid droplets are discharged from the discharge section in a case in which the housing can no longer support the support section, which supports the carriage in a manner in which the carriage is capable of reciprocating, normally.

It is desirable that the liquid droplet discharging apparatus further includes a power source that supplies power to the detection section, that the detection section includes a storage section (i.e. storage or memory) that is capable of storing detection results, and that the control section determines whether or not to execute the warning process on the basis of the detection results that are stored in the storage section.

For example, in a case in which the liquid droplet discharging apparatus is subjected to an impact when the liquid droplet discharging apparatus is transported, or the like, there are cases in which the relative positional relationship between the support section and the housing changes in a state in which the power source of the liquid droplet discharging apparatus is not turned on. With respect to this, since the liquid droplet discharging apparatus with the above-mentioned configuration is provided with a power source that supplies power to the detection section, and a storage section that stores changes in the positional relationship, it is even possible to store changes in the positional relationship in the storage section in a state in which the power source of the liquid droplet discharging apparatus is not turned on. Therefore, it is possible for the control section to rapidly determine whether or not to execute a warning process after the power source of the liquid droplet discharging apparatus is turned on, on the basis of changes in positional relationship that are stored in the storage section.

It is desirable that the liquid droplet discharging apparatus further includes a plurality of power sources (preferably connected in parallel), and that the plurality of power sources supply power in parallel to the detection section.

In this case, even if a portion of the power sources among the plurality of power sources can no longer supply power to the detection section in a case in which, for example, the liquid droplet discharging apparatus is subjected to an impact, or the like, it is possible for another power source to supply power to the detection section. Accordingly, it is possible to improve the reliability of the detection section in a state in which the power source of the liquid droplet discharging apparatus is turned off.

In the liquid droplet discharging apparatus, it is desirable that the control section causes the discharge section to discharge liquid droplets on the basis of a discharge instruction, and determines whether or not to execute the warning process on the basis of the detection results of the detection section after causing the discharge section to discharge liquid droplets on the basis of the discharge instruction, and before causing the discharge section to discharge liquid droplets on the basis of a subsequent discharge instruction.

In this case, a warning process is executed by the control section in a case in which the relative positional relationship between the support section and the housing changes even if it is during the discharge of liquid droplets toward a medium. Accordingly, in the liquid droplet discharging apparatus, in a case in which the discharge section discharges liquid droplets on the basis of a plurality of discharge instructions, when the relative positional relationship between the support section and the housing changes, it is possible to suppress a circumstance in which liquid droplets are discharged from the discharge section after the positional relationship has changed.

In the liquid droplet discharging apparatus, it is desirable that the control section displays a means of contacting (i.e. contact information for) a manufacturer of the liquid droplet discharging apparatus on the display section in the warning process.

In this case, a means of contacting the manufacturer of the liquid droplet discharging apparatus is displayed on the display section in a case in which the warning process is executed. Therefore, a user of the liquid droplet discharging apparatus can quickly take measures to fix the content of the warning.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments in which a liquid droplet discharging apparatus takes on specific forms will be described with reference to the drawings. Additionally, in the present embodiment, the printing apparatus is an ink jet printer that performs printing by discharging an ink, as an example of liquid droplets, onto a medium such as a sheet of paper.

Figure 1:
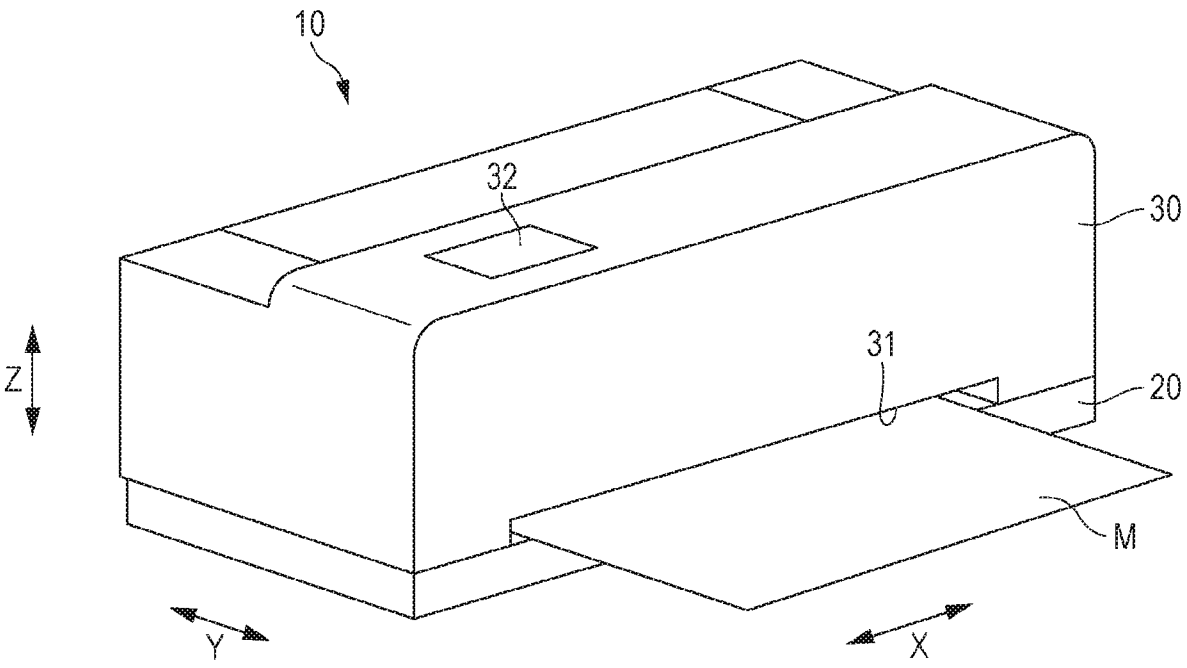
FIG. 1 is a perspective view that shows a schematic configuration of a printing apparatus according to an embodiment.

As shown in FIG. 1, a printing apparatus 10 is provided with a housing 20, which configures a base section of the printing apparatus 10, and a cover 30, which covers the housing 20. An ejection opening 31 for ejecting media M, which has been printed upon, to the outside of the printing apparatus 10 is formed on the front surface of the cover 30. A display section 32, which displays various information of the printing apparatus 10, is provided on the upper surface of the cover 30. The display section 32 may be configured as a liquid crystal display, or the like.

In addition as labeled in FIG. 1, in the following description, the width direction of the printing apparatus 10 is identified as a "width direction X", the front-back direction of the printing apparatus 10 is identified as a "front-back direction Y", and the up-down direction of the printing apparatus 10 is identified as a "vertical direction Z". Additionally, the width direction X, the front-back direction Y, and the vertical direction Z are directions that intersect (are orthogonal to) one another. Furthermore, if one assumes that ejection opening 31 is at a front side of printing apparatus 10, then a right-most end of the printing apparatus 10 in the width direction X may be referred to as a first-end (or right-end as seen from the front), and a left-most end of the printing apparatus 10 in the width direction X may be referred to as a second-end (or left-end as seen from the front).

Figure 2:
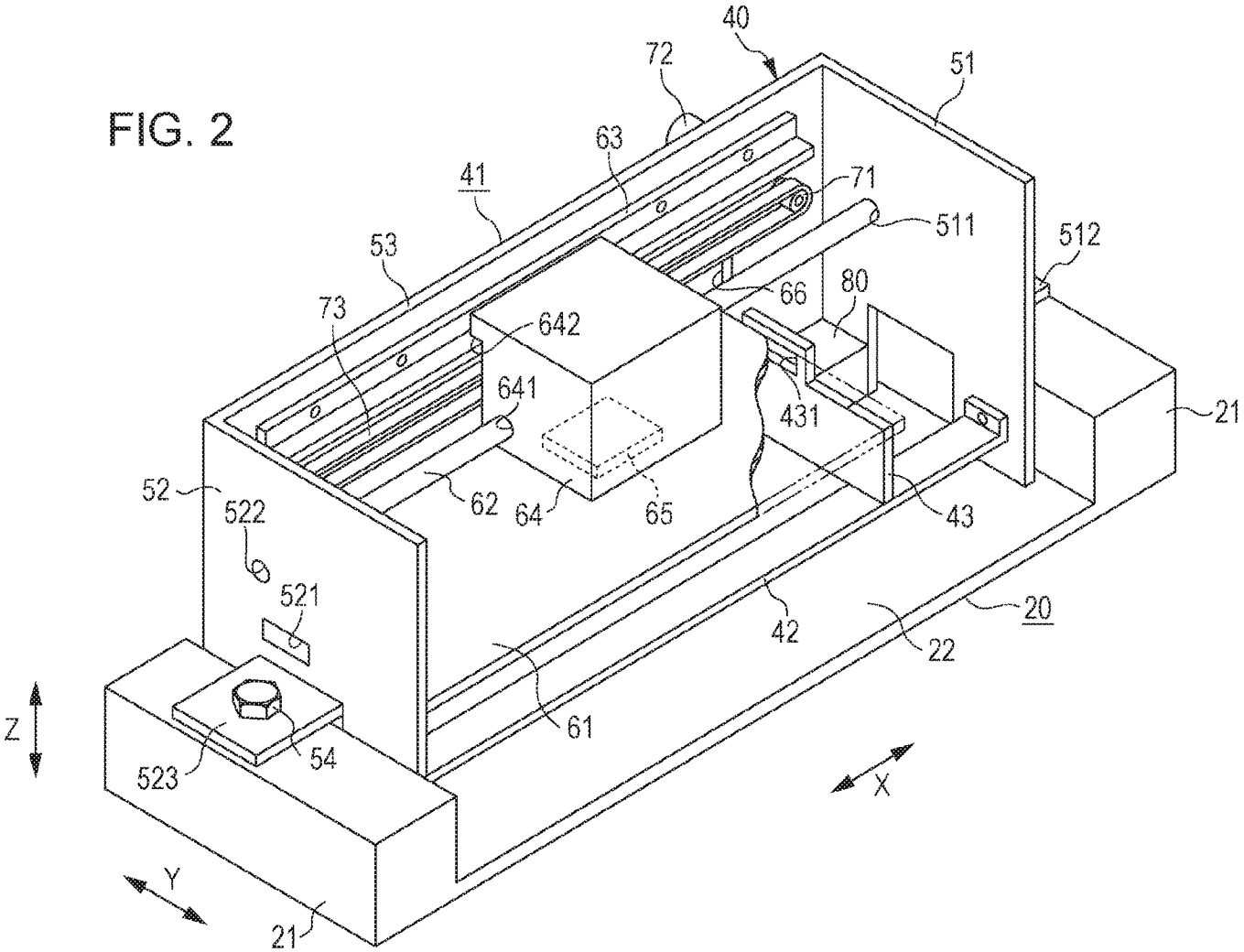
FIG. 2 is a perspective view that shows an internal configuration of the printing apparatus.

As shown in FIG. 2, stepped portions 21 that protrude upward in the vertical direction Z from the base of housing 20, are provided along the front-back direction Y at both opposing ends in the width direction X of the housing 20. An accommodation section 22 that recedes vertically downward from the top of, and between, stepped portions 21, is provided in a central section in the width direction X of the housing 20. Further, the housing 20 supports a frame 40 that is accommodated within accommodation section 22. Various constituent members of the printing apparatus 10 are attached to frame 40.

The frame 40 is provided with a first frame part 41, which is configured to include a first end wall 51, a second end wall 52 and a rear end wall. First end wall 51 is a (right) side wall at the first-end side in the width direction X and running along the front-back direction Y. Second end wall 52 is a (left) side wall at the second-end side in the width direction X and running along the front-back direction Y. Rear wall 53 runs along the width direction X and connects to the first end wall 51 and the second end wall 52 at rearward side of the accommodation section 22 of the printing apparatus 10. In addition, the frame 40 includes a second frame part 42 that connects to the first end wall 51 and the second end wall 52 of the first frame part 41 in the width direction X at locations further forward (e.g. toward the front) than the rear wall 53. Frame 40 may further include a third frame part 43 that connects the rear wall 53 of the first frame part 41 to the second frame part 42 in the front-back direction Y.

Engagement holes 521 and 431 are formed penetrating through the second end wall 52 of the first frame part 41 and the third frame part 43 in the width direction X. A support platform 61, which supports media M across the width direction X and the front-back direction Y, engages with the engagement holes 521 and 431. In this manner, the support platform 61 is supported by the frame 40.

Guide holes 511 and 522 are formed penetrating through the first end wall 51 and the second end wall 52 of the first frame part 41 in the width direction X. The guide holes 511 and 522 are provided vertically above the engagement holes 431 and 521 that engage with the support platform 61, and are provided in positions that are equivalent in the front-back direction Y and the vertical direction Z. Further, a guide shaft 62, for which the width direction X is set as the longitudinal direction, is inserted through the guide holes 511 and 522. In addition, a guide rail 63, for which the width direction X is set as the longitudinal direction, is provided on the rear wall 53 of the first frame part 41. The guide rail 63 is fastened to the rear wall 53 using fastening members such as screws vertically above the guide shaft 62 in the vertical direction Z. In this manner, the guide shaft 62 and the guide rail 63 are supported by the frame 40 in a non-movable manner in which the guide shaft 62 and the guide rail 63 are not capable of moving.

In addition, the guide shaft 62 and the guide rail 63 support a carriage 64 in a manner in which the carriage 64 is capable of moving in the width direction X. To explain in further detail, the guide shaft 62 supports the carriage 64 as a result of being inserted through a sliding hole 641, which is formed penetrating through the carriage 64 in the width direction X. In addition, the guide rail 63 supports the carriage 64 as a result of coming into contact with an extended section 642 of the carriage 64 and supporting the extended section 642 vertically from below. Extended section 642 extends toward the rear from a rear section of the carriage 64. Additionally, when the carriage 64 moves in the width direction X, the guide shaft 62 slides with respect to the sliding hole 641 of the carriage 64, and the guide rail 63 slides with respect to the extended section 642 of the carriage 64.

With respect to this point, in the present embodiment, the frame 40, the guide shaft 62 and the guide rail 63 are an example of a "support section" that supports the carriage 64 in a manner in which the carriage 64 is capable of reciprocating. In addition, in the following description, a relative positional relationship between the housing 20 and the guide shaft 62 and the guide rail 63 of the frame 40, (i.e. a positional relationship between the housing 20 and the "support section") will also be referred to as a relative positional relationship between the housing 20 and the frame 40.

Figure 3:
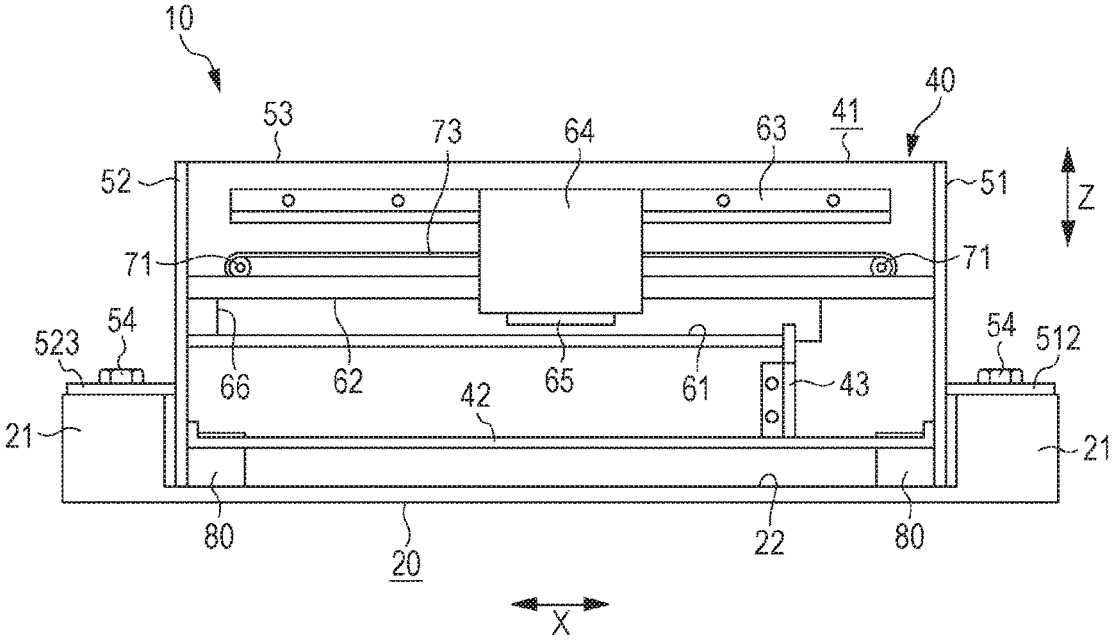
FIG. 3 is a front view that shows an internal configuration of the printing apparatus.

As shown in FIGS. 2 and 3, a supply opening 66, through which a medium M passes when the medium M is supplied to the support platform 61 before printing, is formed penetrating through the rear wall 53 of the first frame part 41. In addition, pulleys 71, which are vertically above the supply opening 66 and for which the front-back direction Y is set as the rotational axes thereof, are provided in the rear wall 53 of the frame 40 proximate to the first end side and second end side in the width direction X. An output shaft of a carriage motor 72 (shown in FIG. 2) is connected to a pulley 71 proximate to the first end side in the width direction X in a drivable manner.

In addition, an endless timing belt 73, to which a portion of the carriage 64 is connected, is wound around the pulleys 71. Accordingly, when the carriage motor 72 is driven, the endless timing belt 73 rotates as a result of the pulleys 71 rotating. Since a pulley 71 is connected to the output shaft of the carriage motor 72 in a drivable manner, and both pulleys 71 are coupled together by endless timing belt 73, both pulleys move when carriage motor 72 is driven. As a result of this, the carriage 64 is moved by the endless timing belt 73 while being guided by the guide shaft 62 and the guide rail 63 in the width direction X when the carriage motor 72 is driven.

The carriage 64 retains a discharge section 65, in which nozzles (not illustrated in the drawing) that discharge an ink (liquid droplets) vertically downward, are formed. Further, in the printing apparatus 10, in a printing state wherein medium M is printed upon, the medium M is intermittently transported in a transport direction, and the ink is discharged toward the medium M from the discharge section 65 while the carriage 64 reciprocates. Additionally, in the present embodiment, the transport direction is forward (toward the front) in the front-back direction.

As shown in FIGS. 2 and 3, the first end wall 51 has a first curved section 512, and the second end wall 52 has a second curved section 523. Curved sections 512 and 523, which extend toward the outer sides in the width direction X, are part of the first frame part 41 and are formed as a result of vertically lower central sections in the front-back direction Y being folded toward the outer sides in the width direction X. In addition, the curved sections 512 and 523 of the first frame part 41 are connected to the stepped portions 21 using a fastening member such as a bolt 54 in a state of being mounted on the stepped portions 21 of the housing 20. In this manner, in the present embodiment, the frame 40 is supported by the housing 20.

In addition, as shown in FIGS. 2 and 3, detection sections 80 for detecting the relative positional relationship between the housing 20 and the frame 40, are provided on an inner side of the frame 40, at locations where the rear wall 53 meets the first end wall 51 and meets the second end wall 52 intersect.

Figure 4:
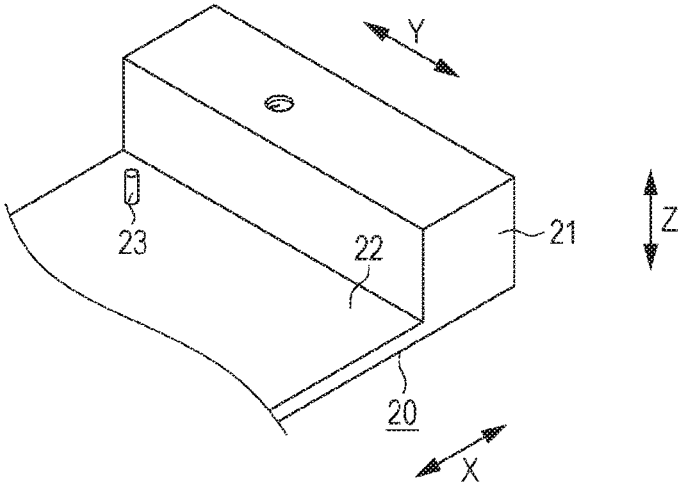
FIG. 4 is a perspective view that shows a partial configuration of a first end side of a housing.

In addition, as shown in FIG. 4, in the accommodation section 22 of the housing 20, a protrusion section 23 that protrudes vertically upward, is provided in a position that corresponds to a detection section 80. The protrusion section 23 may be formed integrally with the accommodation section 22, or may be attached to the accommodation section 22 after being formed separately from the accommodation section 22. In addition, although only one protrusion section 23, which is provided on the first end side in the width direction X, is illustrated in FIG. 4, it is to be understood that a separate a second protrusion section 23 is also provided on the second end side in the width direction X to correspond to the position of the second detection section 80 located at the second end side. That is, a separate protrusion section 23 may be separately provided for each detection section 80.

Figure 5:
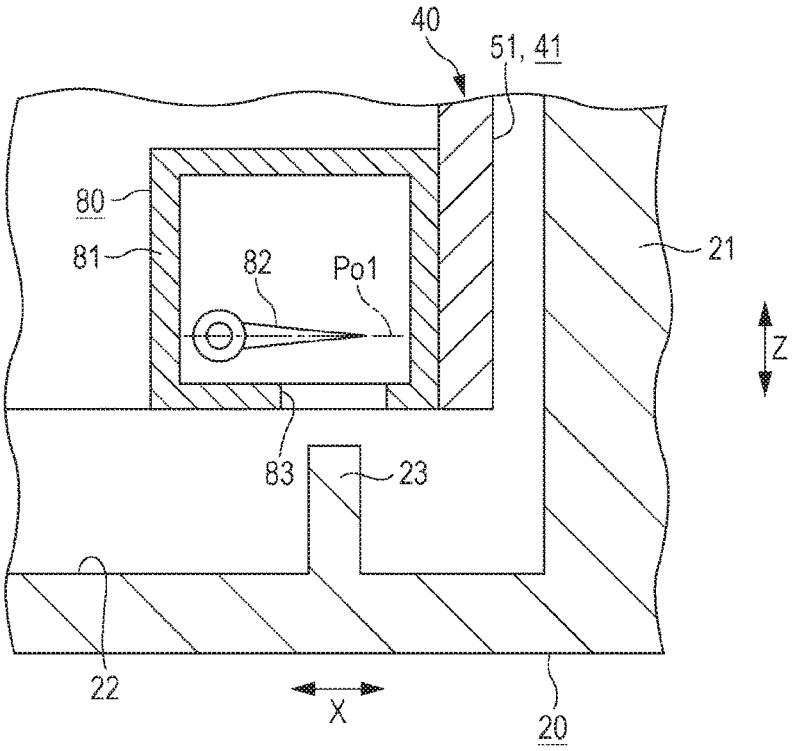
FIG. 5 is a front view that shows a partial cross-section of the printing apparatus when the housing is not supporting a frame.
Figure 6:
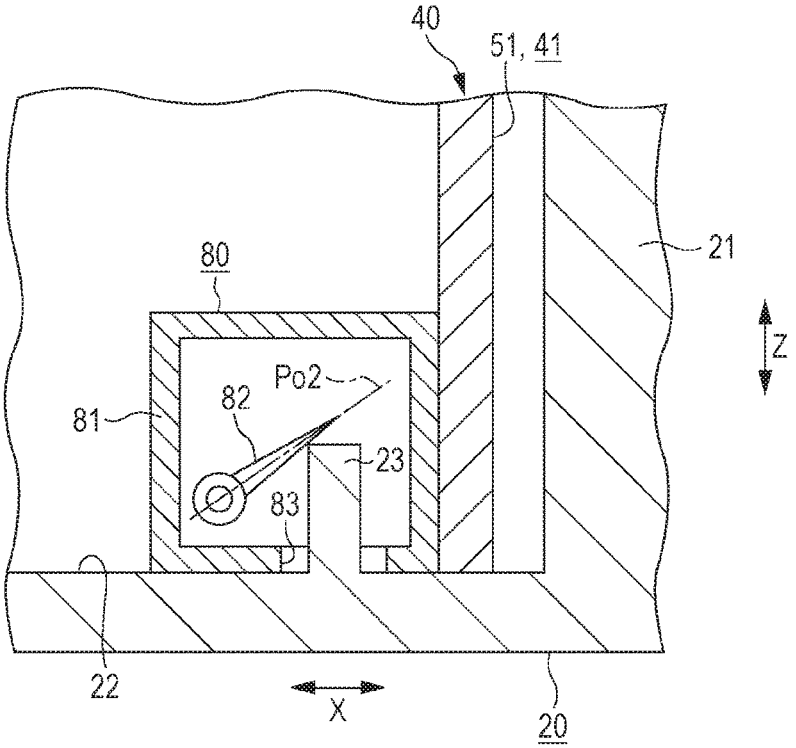
FIG. 6 is a front view that shows a partial cross-section of the printing apparatus when the housing is supporting the frame.
Figure 7:
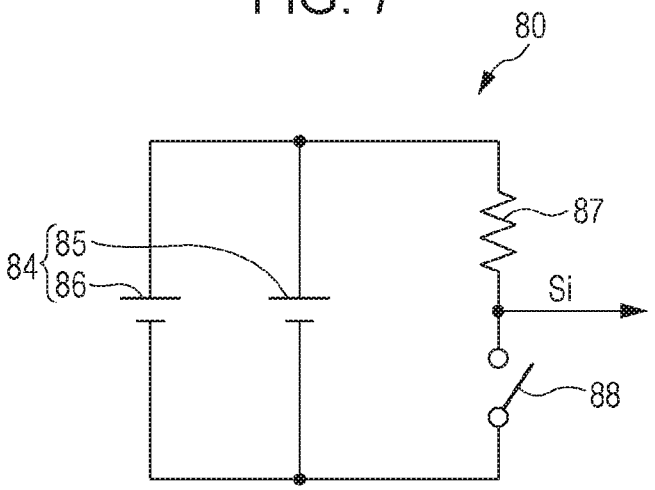
FIG. 7 is a circuit diagram that shows an electrical configuration of a detection section.

Next, the detection sections 80 will be described in detail with reference to FIGS. 5 to 7. More specifically, FIGS. 5 and 6 show a mechanical configuration of the detection sections 80, and FIG. 7 shows an electrical configuration of the detection sections 80. In addition, FIGS. 5 and 6 show a cross-sectional illustration of a partial configuration for ease of description.

As shown in FIGS. 5 and 6, the detection sections 80 are provided with an accommodation chamber 81, which has a box shape. In the example of FIGS. 5 and 6, the accommodation chamber 81 is fixed to the first end wall 51 and is thus integral to the frame 40. It is to be understood that a second detection section at the second end side would have a similar configuration, would be fixed to the second end wall 52, and thus also be integral to frame 40. As shown, a rotational member 82, which is supported in a rotatable (changeable) manner, is located inside the accommodation chamber 81. Furthermore, a communication hole 83, which communicates between the inside and the outside of the accommodation chamber 81, is formed penetrating vertically through a lower section of the accommodation chamber 81 in the vertical direction Z. The communication hole 83 is sized so that the protrusion section 23, which is provided in the accommodation section 22 of the housing 20, may be inserted therethrough. As the protrusion section 23 is inserted through communication hole 83 into accommodation chamber 81, the protrusion section 23 comes into contact with rotational member 82 causing it to rotate.

Further, as shown in FIG. 5, when the housing 20 is not supporting the frame 40, since the protrusion section 23 is not applying a pressing force to the rotational member 82, the rotational member 82 is positioned at a first position Po1 (i.e. a resting position). In addition, as shown in FIG. 6, when the housing 20 is supporting the frame 40 normally, the rotational member 82 is deflected to a second position Po2 (i.e. a fully deflected position) as a result of the protrusion section 23 applying a pressing force to the rotational member 82. In other words, a case in which the convex section 23 cannot apply a pressing force to the rotational member 82 and, as a result, the rotational member 82 is at the first position Po1, is a case in which the housing 20 is not supporting the frame 40 normally. Similarly, if the protrusion section 23 does not sufficiently penetrate into the accommodation chamber 81 to fully deflect rotational member 82 to the second position Po2, then house 20 may also not be supporting frame 40 normally.

As shown in FIG. 7, a power source 84 (i.e. a battery, or including at least one battery) is connected to the detection section 80 in order to make it possible to detect the positional relationship even in a state in which the power source of the printing apparatus 10 is not turned on. The power source 84 includes a first power source 85 and a second power source 86 connected in parallel. In this manner, the first power source 85 and the second power source 86 supply power to the detection section 80 in parallel. Additionally, it is desirable that the power source voltages of the first power source 85 and the second power source 86 be of equivalent voltage values (for example, 5 V). Additionally, apart from the detection section 80, other configurations may preferably be provided so that power is supplied to detection section 80 by the (main) power source of the printing apparatus 10 when the (main) power source of the printing apparatus 10 is turned ON. In this manner, the battery power of power source 84 is conserved when the printing apparatus 10 is turned ON. In another embodiment, battery power of power source 84 may be charged by the (main) power source of the printing apparatus 10 when the (main) power source of the printing apparatus 10 is turned ON. Alternatively, one of the first power source 85 or the second power source 86 may be embodied (or supplied) by the main power source of the printing apparatus 10, and the other power source, 85 or 86, may be a battery. Further alternatively, each of the first power source 85 and second power source 86 may each be embodied by a first battery and second battery, respectively.

In addition, the detection section 80 includes a resistance (e.g. resistor) 87 and a switch 88 that are connected to the power source 84 in series. The switch 88 switches between an ON (i.e. closed) state in which the resistance 87 is connected to a negative electrode side of the power source 84, and an OFF (i.e. opened) state in which the resistance 87 is not connected to the negative electrode side of the power source 84. The state of switch 88 preferably depends on the state of the rotational member 82 that was mentioned above. To explain in more detail, the switch 88 is turned off when the rotational member 82 is at the first position Po1, and is turned on when the rotational member 82 is at the second position Po2. Alternatively, switch 88 is turned on when rotation member 82 is at its second position Po2, and turned off when rotation member 82 is not substantially (or fully) rotated to its second position Po2.

Further, the detection section 80 outputs a voltage value that changes on the basis of the state of the switch 88, as a signal (an output signal Si). That is, the output signal Si is set to a (logic) high level (for example, 5 V) when the switch 88 is off due to the rotational member 82 being at the first position Po1, and the output signal Si is set to a (logic) low level (for example, 0 V) when the switch 88 is on due to the rotational member 82 being at the second position Po2. In addition, first power source 85 and the second power source 86 are connected in parallel, even in a case in which one of the power sources is no longer able to supply power as a result of being removed from the circuit, it is possible for the other power source to supply power.

In addition, in the above-mentioned description, the rotational member 82 and the switch 88 were described as separate structural members, but the rotational member 82 and the switch 88 may be the same structural member.

Next, the electrical configuration of the printing apparatus 10 of the present embodiment will be described with reference to FIG. 8.

Figure 8:
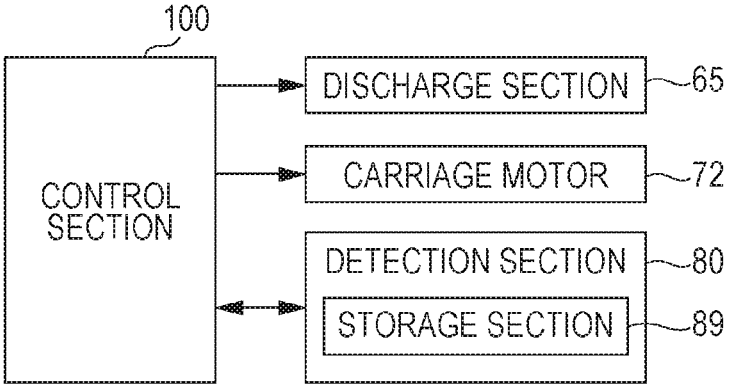
FIG. 8 is a block diagram that shows an electrical configuration of the printing apparatus.

As shown in FIG. 8, the printing apparatus 10 is provided with a control section (i.e. controller) 100 that controls the apparatus integrally. The control section 100 is preferably coupled to have output communication with the discharge section (i.e. discharger) 65, the carriage motor 72 and the detection sections (i.e. detector) 80, and preferably coupled to have input/output communication with the detection sections 80. Further, for example, the control section 100 performs printing on a medium M by controlling driving of the discharge section 65 and the carriage motor 72 on the basis of printing instructions, which are input from a computer, or the like, that is connected to the printing apparatus 10. With respect to this, in the present embodiment, the printing instructions are equivalent to an example of "discharge instructions" that cause the discharge section 65 to discharge the ink.

In addition, the detection section 80 includes a storage section (i.e. memory, or memory store) 89 for storing detection results of the detection section 80 in a state in which the power source of the printing apparatus 10 is not turned on. It is to be understood that in this case, the storage section 89 would also be powered by battery power. The storage section 89 may be non-volatile memory such as EEPROM. The storage capacity of the storage section 89 may be established depending on how much of the detection results of the detection section 80 are desired to be stored when the power source of the printing apparatus 10 is not turned on. For example, in a case in which it is acceptable to store the fact that the relative positional relationship between the housing 20 and the frame 40 has changed at all in a state in which the power source of the printing apparatus 10 is not turned on, the capacity of the storage section 89 may be "1 bit".

In addition, the output signal Si (the detection result) of the detection section 80 is input to the storage section 89 of the detection section 80 and the control section 100. That is, a detection signal of the detection section 80 is output to at least the storage section 89 in a state in which the power source of the printing apparatus 10 is not turned on, and a detection signal of the detection section 80 is input to at least the control section 100 in a state in which the power source of the printing apparatus 10 is turned on.

There is a concern that the positional relationship between the housing 20 and the frame 40 will be changed as a result of the printing apparatus 10 being subjected to an impact, and that the posture of the carriage 64 (and thus also the discharge section 65) will be changed with respect to a medium M that is supported by the support platform 61, as a result. When printing is executed in a state in which the posture of the carriage 64 has changed, a probability that printing will fail arises as a result of a shift occurring in the landing positions of the ink that is discharged toward the medium M from the discharge section 65, which is retained by the carriage 64.

Accordingly, in the present embodiment, in a case in which it is possible to determine that the relative positional relationship between the housing 20 and the frame 40 has changed on the basis of the detection results of the detection section 80, the control section 100 executes a warning process that displays a warning on the display section 32. To explain in more detail, in a case in which the rotational member 82 is disposed in the first position Po1, that is, in a case in which a high level output signal Si is input from the detection section 80, the housing 20 is no longer able to support the frame 40 normally, and the control section 100 executes a warning process. In addition, in a case in which the rotational member 82 is disposed in the second position Po2, that is, in a case in which a low level output signal Si is input from the detection section 80, the housing 20 is able to support the frame 40 normally, and the control section 100 does not execute the warning process.

Figure 9:
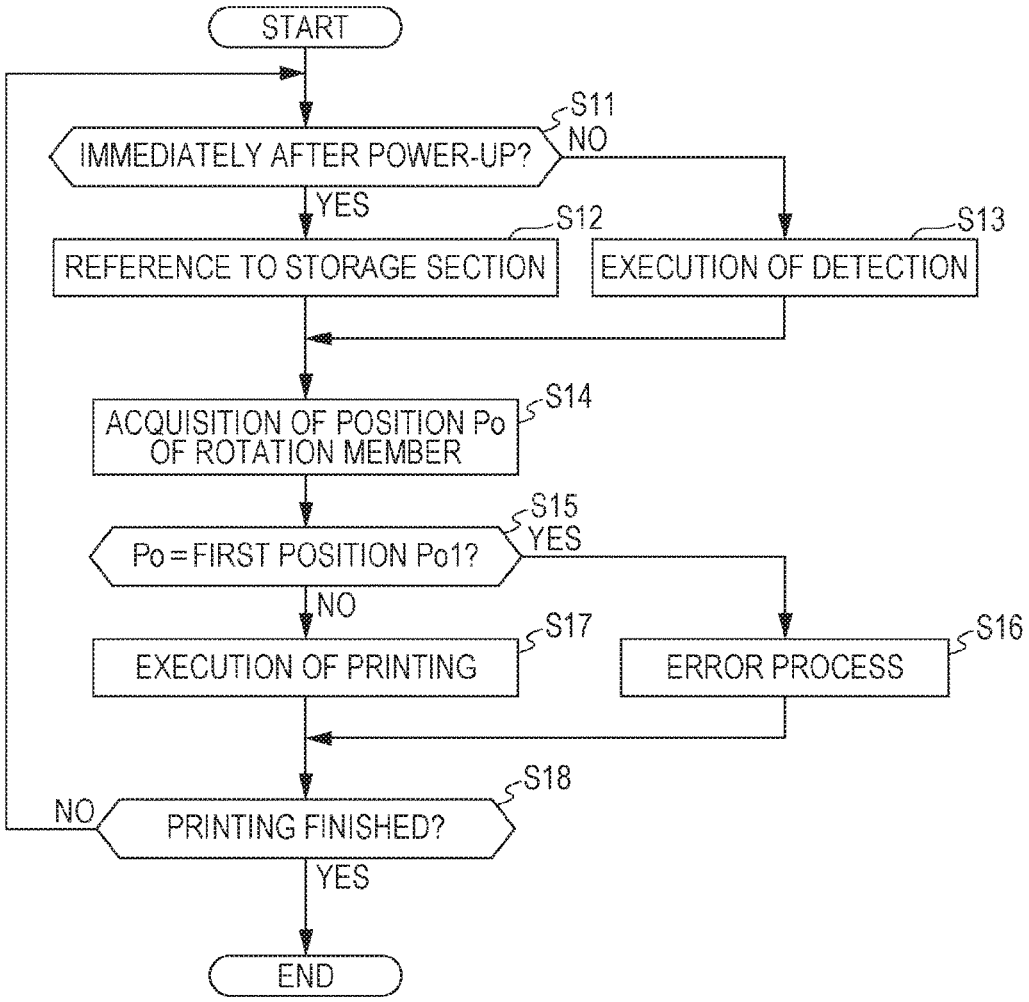
FIG. 9 is a flowchart that shows a process routine that a control section executes in order to perform printing.

Next, a process routine that the control section 100 executes in order to determine whether or not the positional relationship between the housing 20 and the frame 40 is normal when the power source of the printing apparatus 10 is turned on will be described with reference to the flowchart that is shown in FIG. 9.

As shown in FIG. 9, in the present process routine, the control section 100 determines whether or not it is immediately after power-up of the printing apparatus 10 (Step S11). The determination of whether or not it is immediately after power-up may in step S11 be made by control section 100 determining whether a current execution of Step S11 is an initial execution of step 11. If it is, then control section 100 may determine that it is immediately after power-up and step S11 outputs "YES". Conversely, control section 100 may determine that it is not immediately after power-up the current execution of Step S11 is a second or later execution, thus Step S11 would output "NO".

In a case in which it is immediately after power-up (Step S11: YES), the control section 100 refers to the storage section 89 (Step S12), and in a case in which it is not immediately after power-up (Step S11: NO), the control section 100 causes the detection section 80 to execute a detection step (Step S13). Subsequently, the control section 100 acquires a position Po of the rotational member 82 (Step S14) on the basis of the execution results of the previous Steps S12 or S13. That is, in a case in which Step S12 was executed, the control section 100 acquires the position Po of the rotational member 82 in a state when the power source of the printing apparatus 10 was not turned on the basis of information that is stored in the storage section 89. Meanwhile, in a case in which Step S13 was executed, the control section 100 acquires the position Po of the rotational member 82 on the basis of the detection results of the detection sections 80.

Figure 10:
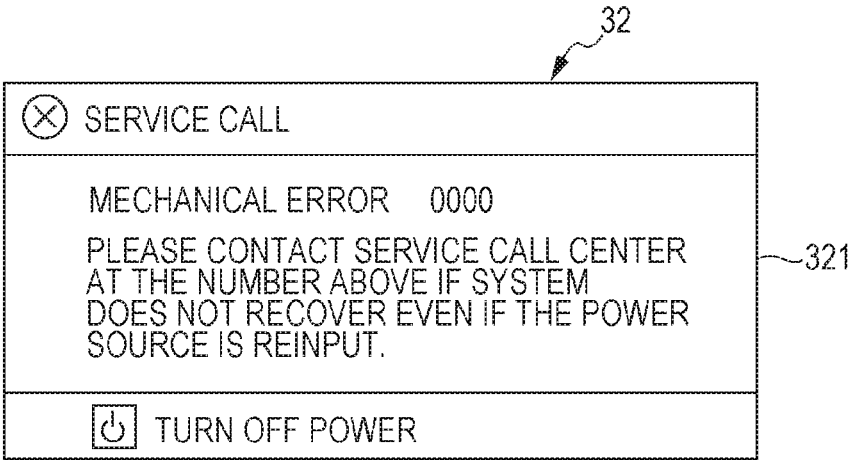
FIG. 10 is a schematic diagram that shows an example of a warning screen that is displayed on a display section.

Further, the control section 100 determines whether or not the acquired position Po is the first position Po1 (Step S15). In a case in which the acquired position Po is the first position Po1 (Step S15: YES), meaning that the housing 20 is not supporting the frame 40 normally, the control section 100 executes an error process (Step S16). In this instance, in the error process, the control section 100 executes a restriction process that restricts the execution of printing, and executes a warning process that displays a warning screen 321, which is shown in FIG. 10, on the display section 32. That is, in the warning process, the control section 100 displays a means of contacting a service center of a manufacturer of the printing apparatus 10 on the display section 32 of the warning screen 321. That is, a telephone number, an email address, or the like, of a service center are displayed on the warning screen 321. Further, thereafter, the control section 100 temporarily finishes the process routine.

Alternatively in Step S15, in a case in which the acquired position Po is the second position Po2 (Step S15: NO), meaning that the housing 20 is supporting the frame 40 normally, the control section 100 executes printing on the basis of the printing instruction (Step S17). To explain in more detail, the control section 100 causes the ink to be discharged toward a medium M by driving the discharge section 65 while moving the carriage 64 in the width direction X as a result of driving the carriage motor 72.

Further, the control section 100 determines whether or not all printing is finished (Step S18), and temporarily finishes the present process routine in a case in which all printing is finished (Step S18: YES). Meanwhile, in a case in which all printing is not finished (Step S18: NO), the control section moves the process to Step S11. That is, in a case in which all printing is not finished (Step S18: NO), determination of whether or not the housing 20 is supporting the frame 40 normally is performed again before printing based on a subsequent printing instruction, is executed.

Next, the actions of printing apparatus 10 of the present embodiment will be described.

Meanwhile, for example, when the printing apparatus 10 is subjected to an impact when the printing apparatus 10 is transported, or the like, there are cases in which the relative positional relationship between the housing 20 and the frame 40 support section (i.e. support frame 40) and the housing changes in a state in which the power source of the printing apparatus 10 is not turned on. That is, there are cases in which the housing 20 is no longer able to support the frame 40 normally as a result of the frame 40 becoming deformed, a fastening member 54 that fastens the housing 20 and the frame 40 together becoming loose, or the like.

Further, in such a case, there is a concern that printing will fail as a result of a shift occurring in the landing positions of the ink that is discharged toward a medium M from the discharge section 65, which is retained by the carriage 64, accompanying the fact that the posture of the carriage 64 with respect to the medium M, which is supported by the support platform 61, has changed.

With respect to this, according to the printing apparatus 10 of the present embodiment, the change in the relative positional relationship between the housing 20 and the frame 40 in a state in which the power source of the printing apparatus 10 is not turned on is detected by the detection section 80, and stored in the storage section 89. Therefore, in a case in which a situation in which the relative positional relationship between the housing 20 and the frame 40 has changed in a state in which the power source of the printing apparatus 10 is not turned on, occurred on the basis of information that is stored in the storage section 89, the warning screen 321 is displayed on the display section 32 after the power source of the printing apparatus 10 is turned on. Further, since the means of contacting the manufacturer is displayed on the warning screen 321, a user can quickly handle the content of the warning.

In addition, when a power source that supplies power to a detection section 80 is removed as a result of the printing apparatus 10 being subjected to an impact in a state in which the power source of the printing apparatus 10 is not turned on, it would typically no longer possible to perform detection using the detection section 80. With respect to this, in the present embodiment, the first power source 85 and the second power source 86 are connected to the detection section 80 in parallel. Therefore, even in a case in which the power source of either one of the first power source 85 or the second power source 86 is removed, a state in which power is supplied to the detection section 80 is continued by the other power source.

In addition, even after the power source of the printing apparatus 10 is turned on, in a case of repeatedly performing printing, it is determined whether or not the relative positional relationship between the housing 20 and the frame 40 has changed using the detection section 80 before printing is performed. Therefore, even if this relative positional shift occurs in the midst of the printing apparatus 10 executing printing on the basis of a plurality of printing instructions, the warning screen 321 is displayed on the display section 32 and the execution of printing is restricting in a case in which the relative positional relationship between the housing 20 and the frame 40 changes.

According to the abovementioned embodiment, it is possible to obtain the following effects.

(1) In a case in which the relative positional relationship between the housing 20 and the frame 40 changes, the change in the positional relationship is detected by the detection section 80 and the warning screen 321 is displayed on the display section 32. In this manner, as a result of warning a user of the printing apparatus 10 of the fact that a change in the positional relationship has occurred, it is even possible to suppress a circumstance in which printing is executed on a medium M in a case in which the housing 20 can no longer support the frame 40, which supports the carriage 64 in a manner in which the carriage is capable of reciprocating, normally.

(2) There are cases in which the relative positional relationship between the housing 20 and the frame 40 changes in a state in which the power source of the printing apparatus 10 is not turned on. With respect to this, according to the above-mentioned embodiment, it is even possible to stores a change in the positional relationship in the storage section 89 in a state in which the power source of the printing apparatus 10 is not turned on. Therefore, the control section 100 can rapidly determine whether or not to execute the warning process after the power source of the printing apparatus 10 is turned on, on the basis of changes in positional relationship that are stored in the storage section 89.

(3) As a result of being provided with the first power source 85 and the second power source 86 as the power sources 84, even if a portion of the power sources among the plurality of power sources 84 can no longer supply power to the detection section 80 as a result of, for example, the printing apparatus 10 being subjected to an impact, or the like, it is possible for the other power source to supply power to the detection section 80. Accordingly, it is possible to improve the reliability of the detection section 80.

(4) By performing determination of whether or not to execute the warning process during an interval between printing instructions, it is possible to execute the warning process using the control section 100 in a case in which the relative positional relationship between the housing 20 and the frame 40 has changed even if it is in the midst of the execution of printing. Accordingly, in the printing apparatus 10, even in a case in which a state in which the discharge section 65 discharges the ink on the basis of a plurality of discharge instructions, continues, in a case in which the relative positional relationship between the housing 20 and the frame 40 changes, it is possible to suppress a circumstance in which the ink is discharged from the discharge section 65.

(5) In a case in which the warning process is executed, a means of contacting the manufacturer of the printing apparatus 10 (the warning screen 321) is displayed on the display section 32. Therefore, a user of the printing apparatus 10 can quickly take measures to fix the content of the warning.

(6) In addition, since the restriction process, which restricts the execution of printing is executed along with the warning process, it is possible to suppress a circumstance in which printing is executed in a state in which the relative positional relationship between the housing 20 and the frame 40 has changed.

Additionally, the abovementioned embodiment may be changed in the following manner.

Figure 11:
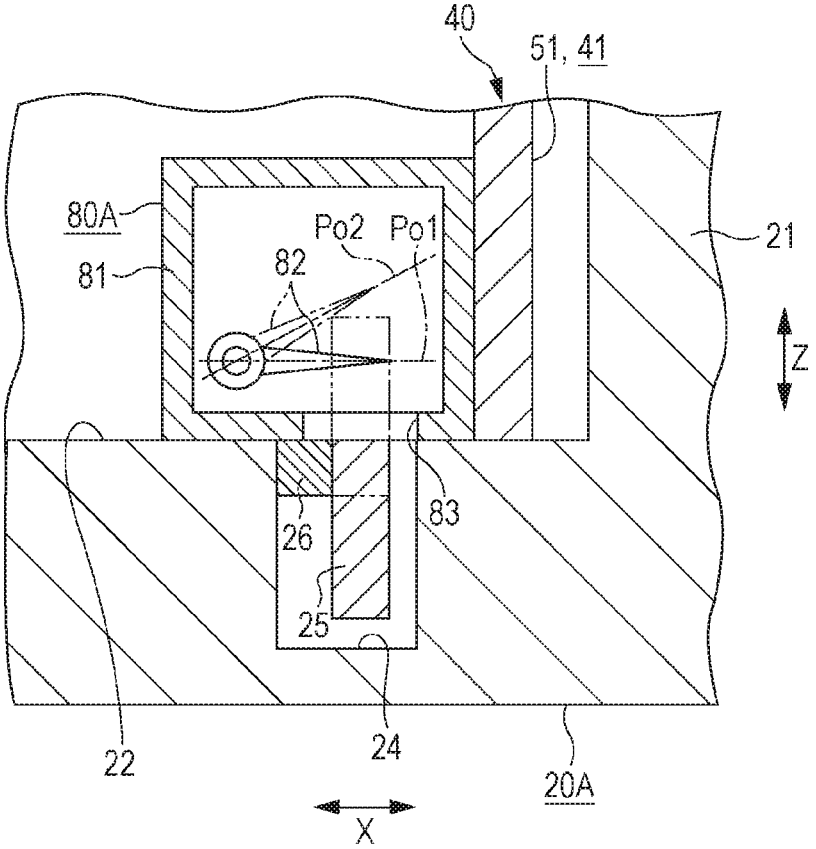
FIG. 11 is a front view that shows a partial cross-section of a printing apparatus in another embodiment.

The detection section 80 in the above-mentioned embodiment may be a detection section 80A such as that shown in FIG. 11. Additionally, in the description of the printing apparatus 10 in other embodiments below, the same reference numerals (i.e. reference characters) will be given to member configurations that are the same as those of the first embodiment, and description thereof will be omitted or abbreviated.

As shown in FIG. 11, a shaft 24 is provided in a manner that is collapsed vertically downward in a position that corresponds to the detection section 80A of a housing 20A of this other embodiment. A pressing force member 25, which is capable of ascending and descending along the vertical direction Z, and an elevating mechanism 26, which corresponds to a driving source when causing the pressing force member 25 to ascend and descend, are accommodated in the shaft 24. As an example, the pressing force member 25 may be caused to ascend and descend by forming a rack on the pressing force member 25 and providing a pinion, which engages with the rack, and a motor, which drives the pinion, on the elevating mechanism 26.

By driving of the elevating mechanism 26, the pressing force member 25 applies a pressing force to the rotational member 82 within the detection section 80A. This pressing force displaces the rotational member 82 to the second position Po2 in the manner shown by the dashed-two-dotted line in FIG. 11. In addition, the pressing forced may be cancelled (i.e. removed) by performing reverse driving of the elevating mechanism 26, which causes the pressing force member 25 to retreat back into pocket 24. The detection section 80A displaces (i.e. restores) the rotational member 82 back to the first position Po1 in the manner shown by the solid line in FIG. 11 when pressing force from the pressing force member 25 is cancelled.

Figure 12:
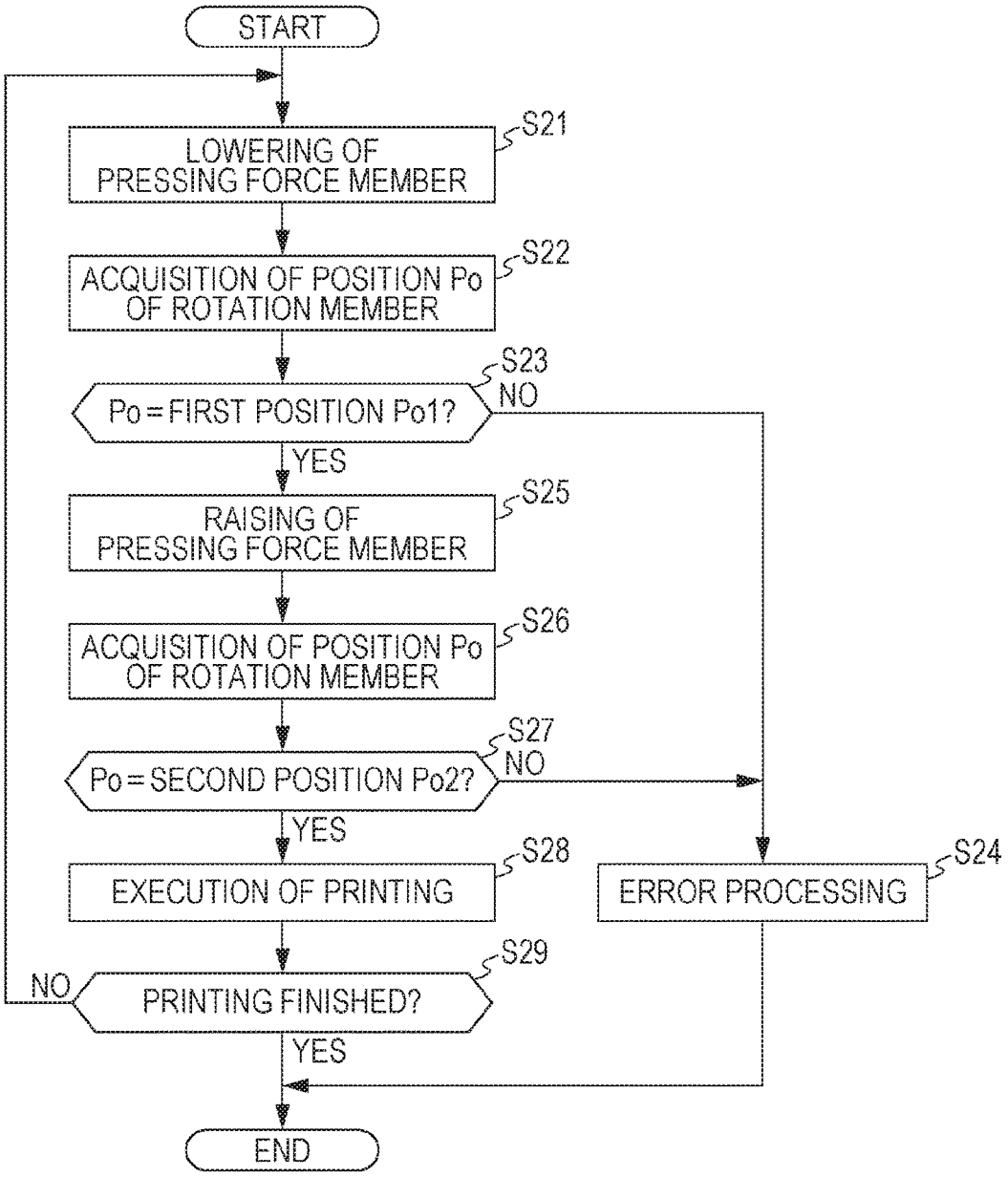
FIG. 12 is a flowchart that shows a process routine that a control section executes in order to perform printing in the other embodiment.

Next, a process routine that the control section 100 executes in order to perform printing on a medium M on the basis of a detection result of the detection section 80A will be described with reference to the flowchart that is shown in FIG. 12.

As shown in FIG. 12, in the present process routine, the control section 100 causes the pressing force member 25 to descend (Step S21) by driving the elevating mechanism 26, and acquires the position Po of the rotational member 82 on the basis of the detection result of the detection section 80A (Step S22). Subsequently, the control section 100 determines whether or not the acquired position Po of the rotational member 82 is the first position Po1 (Step S23). Step S23 effectively checks if detection section 80A is functioning properly. If the acquired position Po is the first position Po1, as expected, then the detection section 80A is working normally, but if the acquired position Po is not the first position Po1, then the detection section 80A has malfunctioned. In a case in which the position Po of the rotational member 82 is not disposed in the first position Po1 (Step S23: NO), the control section 100 performs an error process (Step S24).

In this instance, as shown by the solid line in FIG. 11, in a case in which the pressing force member 25 descends, normally, the rotational member 82 is disposed in the first position Po1. Therefore, regardless of the fact that the pressing force member 25 is caused to descend, the detection section 80A is not operating normally in a case in which the rotational member 82 is disposed in the second position Po2. Additionally, causes of the detection section 80A not operating normally include the rotational member 82 not being able to rotate from the second position Po2, the elevating mechanism 26 no longer being able to be driven, and the like.

In this manner, in a case in which Step S23 is determined to be negative (Step S23: NO), in the error process, the fact that an error has occurred in the detection section 80A is displayed in the display section 32. In addition, with respect to this, in the present embodiment, the process of Step S23 can be referred to as a diagnosis process that diagnoses whether or not the detection section 80A is operating normally.

Alternatively in Step S23, in a case in which the position Po of the rotational member 82 is disposed in the first position Po1 (Step S23: YES), the control section 100 causes the pressing force member 25 to ascend (Step S25) by driving the elevating mechanism 26, and acquires the position Po of the rotational member 82 on the basis of the detection result of the detection section 80A (Step S26). Subsequently, the control section 100 determines whether or not the acquired position Po of the rotational member 82 is the second position Po2 (Step S27).

In a case in which the position Po of the rotational member 82 is not disposed in the second position Po2 (Step S27: NO), the control section 100 performs an error process.

In this instance, as shown by the dashed-two-dotted line in FIG. 11, in a case in which the pressing force member 25 ascends, normally the rotational member 82 would be disposed to the second position Po2. Therefore, regardless of the fact that the pressing force member 25 is caused to ascend, the housing 20A is not able to support the frame 40 normally in a case in which the rotational member 82 is not disposed in the second position Po2, and therefore, it can be determined that the printing apparatus 10 is in a state in which the pressing force member 25 is not able to apply a pressing force to the rotational member 82.

In this manner, in a case in which Step S27 is determined to be negative (Step S27: NO), in the error process, the fact that the housing 20A is not able to support the frame 40 normally is displayed in the display section 32. Meanwhile, in Step S27, in a case in which the position of the rotational member 82 is disposed in the second position Po2 (Step S27: YES), the control section 100 executes printing on the basis of a printing instruction (Step S28).

Further, the control section 100 determines whether or not all printing is finished (Step S29), and finishes the present process routine to reach a case in which all printing is finished (Step S29: YES). Meanwhile, in a case in which all printing is not finished (Step S29: NO), the control section 100 moves the process to Step S21. That is, in a case in which all printing is not finished (Step S29: NO), determination of whether or not the housing 20A is supporting the frame 40 normally is performed again before printing based on a subsequent printing instruction, is executed.

According to the other embodiment described above, in addition to the effects of the above-mentioned embodiment, it is possible to diagnose whether or not a problem has arisen in the operation of the detection section 80A before the detection section 80A performs detection of whether or not the relative positional relationship between the frame and the housing 20A has changed. In addition, since it is possible to set the pressing force member 25 so that it does not protrude from the housing 20A, it is possible to easily handle the housing 20A during an assembly step of the printing apparatus 10.

When an amount of displacement of the rotational member 82 when the switch 88 of the detection section 80 is turned from off to on, is set as a reference amount of displacement, the reference amount of displacement may be set arbitrarily. For example, in a case in which the relative positional relationship between the housing 20 and the frame 40 changes slightly as a result of the printing apparatus 10 being subjected to a weak impact, the reference amount of displacement may be set to be small. Meanwhile, in a case in which the relative positional relationship between the housing 20 and the frame 40 changes greatly as a result of the printing apparatus 10 being subjected to a strong impact, the reference amount of displacement may be set to be large.

The position in which the detection section 80 is provided, and the number of detection sections 80 that are provided may be set arbitrarily. Additionally, it is desirable that the detection sections 80 be provided at positions that are thought to be likely to be subjected to an impact when transporting the printing apparatus 10, and are provided at positions at which a gap is likely to form when the fastening member 54 becomes loose, and the like.

The rotational member 82 of the detection section 80 may, for example, be a displacement member that is displaced in a linear manner along the vertical direction Z. In this case, it is desirable that a state of the switch 88 changes depending on the disposition of the displacement member.

In addition, a direction that intersects the front-back direction Y (for example, the width direction X or the vertical direction Z) may be set as the rotational axis of the rotational member 82 of the detection section 80.

There may be a single power source 84 (the battery) that supplies power to the detection section 80, or there may be three or more thereof. In addition, in a case in which there are two or more power sources 84, the power sources 84 may be disposed in positions that are separated from one another. According to this configuration, in a case in which the printing apparatus 10 is subjected to an impact, it is possible to make it difficult to remove power sources 84 that are disposed in positions that are far away from a location that is subjected to an impact.

In addition, a power source 84 that supplies power to the detection section 80 need not be provided. Even in this case, it is possible to determine whether or not to execute the warning process on the basis of the relative positional relationship between the housing 20 and the frame 40 based on a detection result of the detection section 80 after power-up of the printing apparatus 10.

As long as the detection section 80 is capable of detecting a change in the relative positional relationship between the housing 20 and the frame 40, the detection section 80 may be another sensor. That is, as long as the detection section 80 is a sensor that is capable of measuring a distance between an arbitrary position in the housing 20 and an arbitrary position in the frame 40, the detection section 80 may be another sensor. In this instance, the arbitrary position in the housing 20 and the arbitrary position in the frame 40 may be separated from an initial position or may be in contact with the initial position.

For example, the detection section 80 may be a reflective photoelectric sensor. In this case, it is possible to detect a change in the relative positional relationship between the housing 20 and the frame 40 depending on whether or not the distance between an arbitrary position in the housing 20 and an arbitrary position in the frame 40, which is calculated depending on the intensity of reflected light, has changed.

In addition, the detection section 80 may be a piezoelectric element that is disposed in a gap between the housing 20 and the frame 40. In this case, since a voltage value that is created by the piezoelectric element, changes depending on changes in the size of the gap between the housing 20 and the frame 40, it is possible to detect a change in the relative positional relationship between the housing 20 and the frame 40 on the basis of a change in the voltage value. In this case, if it is possible to write information that is stored in the storage section 89 using a voltage (a signal) that the piezoelectric element creates, it is not necessary provide the power source 84, and therefore, it is possible to simplify the detection section 80.

In the above-mentioned embodiments, the support platform 61 was supported by the frame 40, but the support platform 61 may be supported by the housing 20.

Temporal changes in the relative positional relationship between the housing 20 and the frame 40 in a state in which the power source of the printing apparatus 10 is not turned on may be stored in the storage section 89. In this case, determination of whether or not the relative positional relationship between the housing 20 and the frame 40 has changed may be performed on the basis of temporal changes in the positional relationship.

The display section 32 need not be provided in the printing apparatus 10. For example, the display section 32 may be provided in a personal computer or a smartphone that is connected to the printing apparatus 10 in a wired or wireless manner.

A means of contacting the manufacturer of the printing apparatus 10 need not be displayed on the warning screen 321 that is shown in FIG. 10.

In addition, a company name, a trademark or a logo that indicate the manufacturer (the origin) of the printing apparatus 10 may be displayed on the warning screen 321 that is shown in FIG. 10 in a manner in which the manufacturer of the printing apparatus 10 can be recognized. In addition, the trademark or logo of the printing apparatus 10 may be displayed.

The printing apparatus 10 may be a liquid droplet discharging apparatus that discharges liquid droplets other than ink. Additionally, as a state of a liquid that is discharged as minute liquid droplets from the liquid droplet discharging apparatus, it is possible to include granules, tears, and filaments that leave a trail. In addition, for example, the liquid that is referred to in this instance may be any material in a state in which the matter is in a liquid phase, and includes liquid state materials with high and low viscosities, and fluid state materials such as sols, gel waters, other inorganic solvents, organic solvents, liquid solutions, liquid resins, and liquid metals (metallic melts).

In addition, the liquid droplet discharging apparatus may be a liquid droplet discharging apparatus that discharges living organic material that is used in the manufacture of biochips, a liquid droplet discharging apparatus that discharges liquids that form specimens that are used as precision pipettes, a printing apparatus, a microdispenser or the like. Furthermore, the liquid droplet discharging apparatus may be a liquid droplet discharging apparatus that discharges a lubricating oil with pinpoint precision in a precision instrument such as a watch or a camera, a liquid droplet discharging apparatus that discharges a transparent resin liquid such as an ultraviolet curable resin for forming a microhemispherical lens (an optical lens) or the like that is used in optical communication elements or the like onto a substrate. In addition, the liquid droplet discharging apparatus may be a liquid droplet discharging apparatus that discharges an etching liquid such as an acid or an alkali for etching a substrate.

What is claimed is:

1. A liquid droplet discharging apparatus comprising:

a carriage that carries a discharger that discharges liquid droplets onto a medium;

a support frame that supports the carriage in a manner in which the carriage is capable of reciprocating movement;

a housing that supports the support frame;

a position detector configured to detect a relative positional relationship between the support frame and the housing, the position detector including a rigid protrusion extending along a protruding direction from the housing toward the support frame and a deflectable member affixed to the support frame and accessible through a hole in the support frame, wherein the protrusion is positioned to pass through the hole and deflect the deflectable member along the protruding direction when the housing supports the support frame; and a controller that executes a warning process that displays a warning on a display if the position detector detects a change in the relative positional relationship between the support frame and the housing, and that does not execute the warning process if the position detector does not detect said change in the relative positional relationship.

2. The liquid droplet discharging apparatus according to claim 1, further comprising a power source that supplies power to the detection section, wherein:

the position detector includes a storage that stores detection results, and the controller determines whether or not to execute the warning process on the basis of the detection results stored in the storage.

3. The liquid droplet discharging apparatus according to claim 2, further comprising a plurality of power sources, wherein the plurality of power sources supply power in parallel to the position detector.

4. The liquid droplet discharging apparatus according to claim 1, wherein the controller causes the discharger to discharge liquid droplets on the basis of a discharge sequence including a plurality of discharge instructions, and determines whether or not to execute the warning process on the basis of the detection results of the position detector after causing the discharger to discharge liquid droplets on the basis of a current discharge instruction in the discharge sequence and before causing the discharger to discharge liquid droplets on the basis of a subsequent discharge instruction in the discharge sequence.

5. The liquid droplet discharging apparatus according to claim 1, wherein the controller displays contact information for a manufacturer of the liquid droplet discharging apparatus on the display as part of the warning process.

6. The liquid droplet discharging apparatus according to claim 1, wherein:

the position detector includes a deflection sensor, which senses an amount of deflection of the deflectable member;

a target deflection position is defined as an amount of deflection, as determined by the deflection sensor, of the deflectable member by the protrusion member when the support frame is in a desired supported position within the housing; and and the position detector monitors a current deflection position of the deflection member, as sensed by the deflection sensor, and determines a misalignment, between a current position and the desired supported position, based on a deflection difference between the current deflection position and the target deflection position.

7. The liquid droplet discharging apparatus according to claim 6, wherein:

the rigid protrusion, deflectable member and hold are part of a first position sensor;

the position detector further include a second of said position sensor; and the first position sensor is positioned proximate to a first width-end of the support frame, and the second position sensor is positioned proximate to a second width-end of the support frame opposite the first width-end of the support frame.

8. The liquid droplet discharging apparatus according to claim 6, wherein:

the deflection member is a rotary member, and the amount of deflection sensed is based on an amount of rotation of the deflection member.

9. The liquid droplet discharging apparatus according to claim 1, wherein the rigid protrusion is retractable into a shaft of the housing.

10. The liquid droplet discharging apparatus according to claim 6, wherein the deflection sensor issues a first logic signal in response to the current deflection position matching the target deflection position, and issue a second logic signal in response to the current deflection position not matching the target deflection position.

11. The liquid droplet discharging apparatus according to claim 6, wherein the deflection sensor includes:

a first resistive element and a switch connected in series between a first power rail and a second power rail, an open or closed state of the switch being indicative of whether the current deflection position matches the target deflection position or not.

12. The liquid droplet discharging apparatus according to claim 11, further comprising a first power source and second power source connected in parallel between the first power rail and second power rail, and connected in parallel with the series connected resistive element and switch;

wherein the first power source powers the liquid droplet discharging apparatus including the position detector when the liquid droplet apparatus is turned on, and the second power source powers the position detector when the liquid droplet discharging apparatus is turned off.

* * * * *